US009509040B2

(12) United States Patent
Chen et al.

(10) Patent No.: US 9,509,040 B2
(45) Date of Patent: Nov. 29, 2016

(54) ANTENNA ASSEMBLY AND MOBILE TERMINAL USING SAME

(71) Applicants: Yongli Chen, Shenzhen (CN); Chao Wang, Shenzhen (CN)

(72) Inventors: Yongli Chen, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 199 days.

(21) Appl. No.: 14/280,838

(22) Filed: May 19, 2014

(65) Prior Publication Data

US 2014/0347229 A1 Nov. 27, 2014

(30) Foreign Application Priority Data

May 24, 2013 (CN) ..... 2013 1 0198271

(51) Int. Cl.
*H01Q 1/24* (2006.01)
*H01Q 9/42* (2006.01)
*H01Q 5/371* (2015.01)

(52) U.S. Cl.
CPC ..... *H01Q 1/243* (2013.01); *H01Q 5/371* (2015.01); *H01Q 9/42* (2013.01)

(58) Field of Classification Search
CPC ..... H01Q 1/243; H01Q 1/38; H01Q 9/0421; H01Q 1/42
USPC ..... 343/702, 872, 878
See application file for complete search history.

(56) References Cited

U.S. PATENT DOCUMENTS

2012/0176279 A1* 7/2012 Merz ..... H01Q 1/243 343/702
2013/0099996 A1* 4/2013 Tseng ..... H01Q 1/243 343/876
2013/0102357 A1* 4/2013 Vance ..... H01Q 1/243 455/550.1

* cited by examiner

*Primary Examiner* — Dameon E Levi
*Assistant Examiner* — Collin Dawkins
(74) *Attorney, Agent, or Firm* — Na Xu; IPro, PLLC

(57) ABSTRACT

An antenna assembly is disclosed. The antenna assembly includes a radiation body, an antenna feed portion, a RF feed portion, a first branch having one end electrically connecting to the antenna feed portion, and another end electrically connects to a first feed point of the radiation body, the first feed point dividing the radiation body into a first radiation portion and a second radiation portion. The antenna assembly further includes a second branch electrically connecting to a second feed point of the second radiation portion, an impedance matching circuit coupled between the antenna feed portion and the RF feed portion. The impedance matching circuit receives the low frequency signals and matches the impedance, then feeds to the antenna feed portion.

6 Claims, 3 Drawing Sheets

ANTENNA ASSEMBLY AND MOBILE TERMINAL USING SAME

FIELD OF THE INVENTION

The disclosure described herein relates to mobile terminals, and more particularly to an antenna assembly used in such a mobile terminal.

DESCRIPTION OF RELATED ART

Nowadays, a mobile terminal, such as a phone, for obtaining a fashion appearance, which uses a metal shell is desired. Compared with other shells made of other materials, metal shells not only have a fashion appearance, but also have many other advantages, such as a better stiffness, a greater strength, a thinner thickness, recyclable, a better heat radiation and so on. However, a metal shell will form a fatal electromagnetic shielding effect to an antenna located therein. For solving that problem, some phone designs, such as iPhone design, use a metal frame antenna to feed for the metal shell directly. Although this design solves the problem of antenna radiating in metalic environment, but a new problem appears. When a phone using a metal frame antenna to feed for the metal shell directly is being held by a hand, the hand will affect the performance of the metal frame antenna devastatingly.

The present disclosure is accordingly provided to solve the problems mentioned above.

DETAILED DESCRIPTION OF THE EXEMPLARY EMBODIMENT

The present invention will hereinafter be described in detail with reference to an exemplary embodiment.

Figure 1:
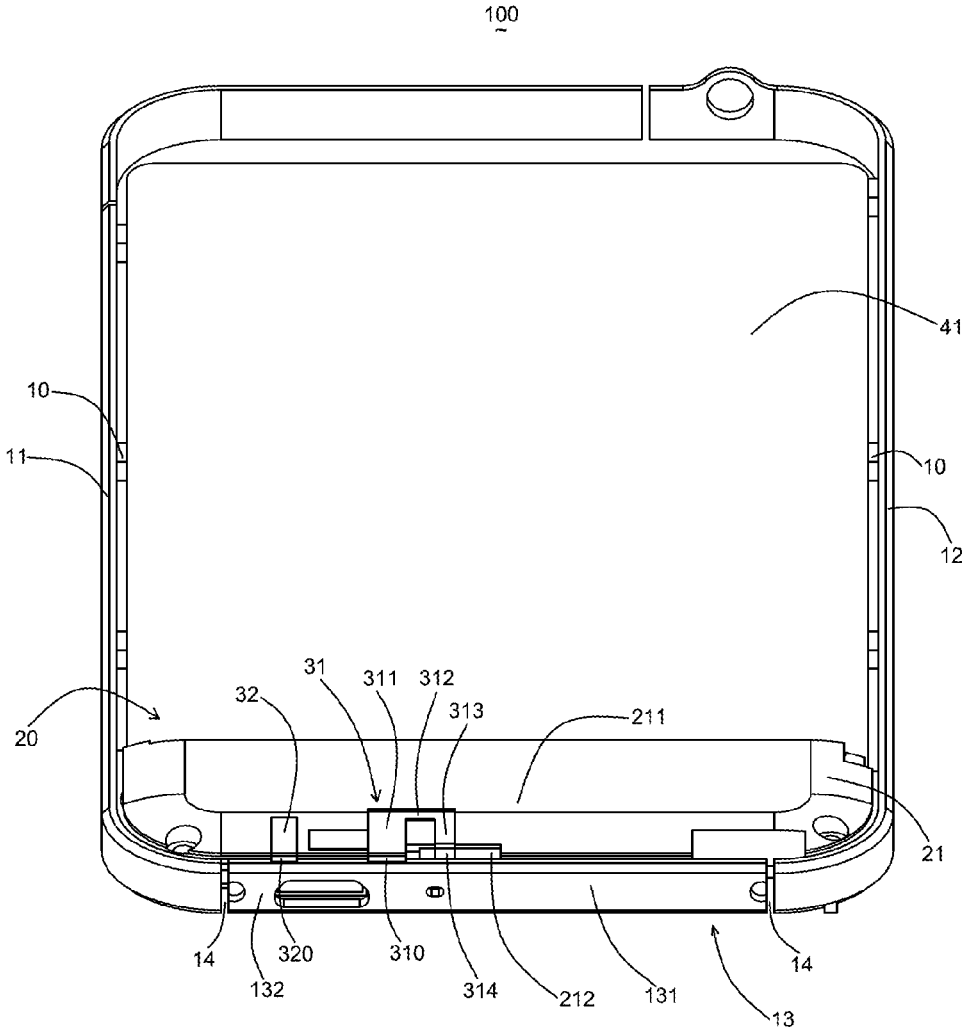
FIG. 1 is a simplified illustration of a mobile terminal of the present disclosure.
Figure 2:
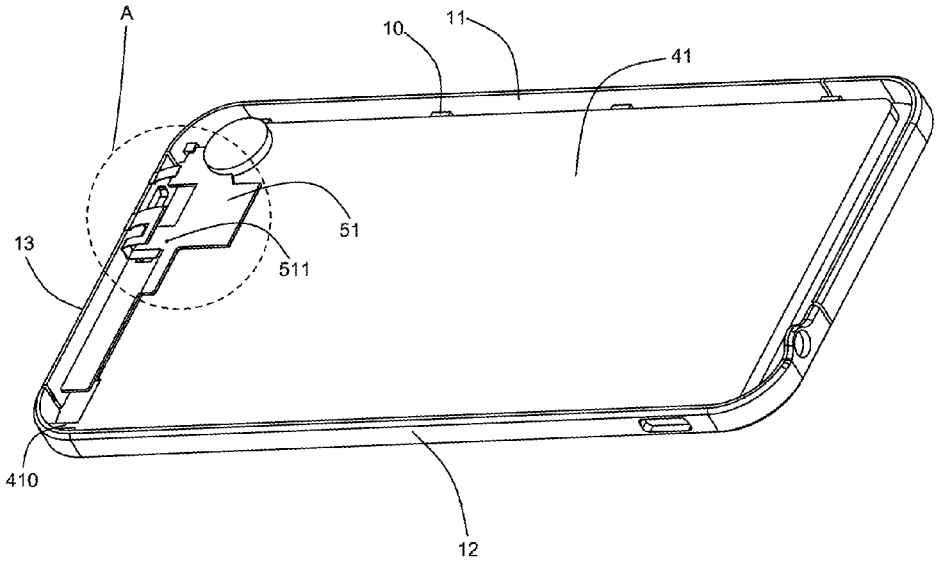
FIG. 2 is an illustration of an antenna assembly used in the mobile terminal in FIG. 1.
Figure 3:
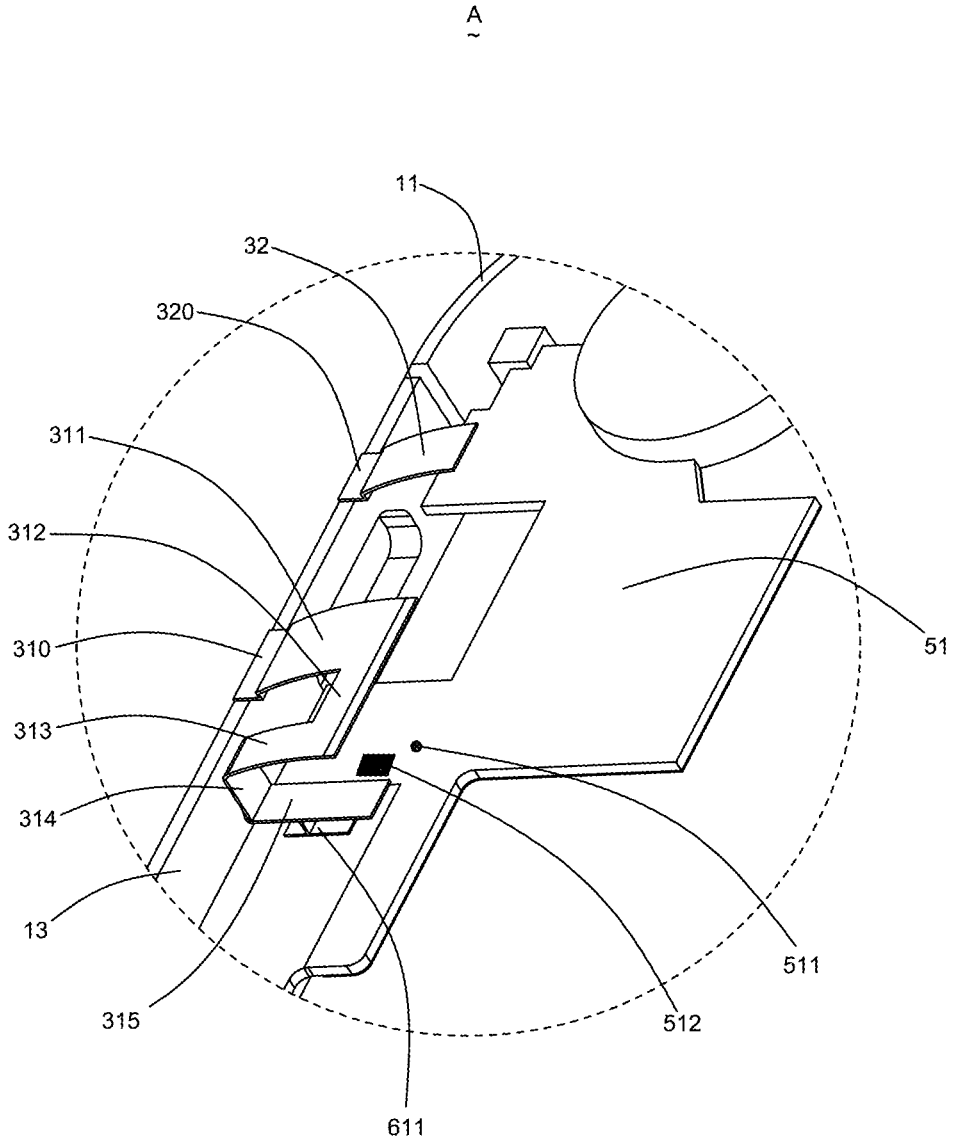
FIG. 3 is an enlarged view of Part A in FIG. 2.

Referring to FIGS. 1-3, an electronic device 100 in accordance with an exemplary embodiment of the present invention includes a metal frame. The metal frame includes a first holding portion 11, a second holding portion 12 opposed to the first holding portion 11, and a connection portion 13 located between the first and second holding portions 11, 12 at a first end of the frame. Two ends of the connection portion 13 forms a gap 14 relative to the first and second holding portions 11, 12, respectively. The metal frame forms receiving space, and the electronic device 100 further includes a speaker 20, a mother board 51 and a ground plate 41 accommodated in the receiving space. The ground plate 41 includes a plurality of grounding pads 410.

The speaker 20 comprises a housing 21 defining an upper surface 211, a lower surface opposed to the upper surface 21, and a side surface 212 connecting the upper and lower surfaces.

An antenna assembly used in the electronic device of this disclosure uses the connection portion 13 as a radiation body thereof. The radiation body, i.e., the connection portion 13, has a first feed point 310 for dividing the radiation portion into a first radiation portion 131 and a second radiation portion 132. The second radiation portion 132 includes a second feed point 320. In addition, the antenna assembly includes a first branch 31, a second branch 32, an antenna feed portion 611, and a RF feed portion 511 (Radio Frequency feed portion) mounted on the mother board 51. One end of the first branch 31 electrically connects to the antenna feed portion 611, and another end of the first branch 31 electrically connects to the feed point 310. The second branch 32 electrically connects to the second feed point 320, and the second branch 32 locates on the upper surface 211 of the housing 21.

The first branch 31 includes a first segment 311, a second segment 312 extending vertically from a distal end of and far away from the first segment 311, a third segment 313 extending vertically from the second segment 312 toward the radiation body, a fourth segment 314 extending from the third segment 313 and mounted on the side surface 212 of the housing 21, and a fifth segment 315 extending from the fourth segment 314 and arranged on the lower surface of the housing 21. A width of the first segment 311 is greater than that of the third segment 313, and the fifth segment 315 electrically connects to the antenna feed portion 611.

The antenna assembly further includes an impedance matching circuit 512 coupled between the RF feed portion 211 and the antenna feed portion 611. Optionally, the impedance matching circuit 512 comprises a capacitor parallel connected with an inductance. The impedance matching circuit 512 receives the low frequency signals and matches the impedance, then feeds to the antenna feed portion 611. Accordingly, the antenna assembly radiates low frequency signals.

The electronic device further includes a plurality of ground terminals 10 at inner side of the first and second holding portions 11, 12. For ground the first and second holding portions 11, 12, the ground terminals 10 electrically connects to the ground plate 41, or the grounding pads 410 electrically connects to the inner sides of the first and second holding portions 11, 12.

The antenna assembly of the present disclosure is compatible with GS900, DCS1800, PCS1900 and WCDMA.

The first branch 31 is formed by bending for lengthening the length of the antenna assembly and further making the length approach ¼ wavelength. The impedance circuit 512 enables better receiving the power from the antenna feed portion.

The second branch 32 lengthens the length of the radiation body, and reduces the frequency to wanted frequency below 2170 MHz.

Two gaps 14 separates the radiation body, i.e., the connection portion 13 from the holding portions, and the holding portions form ground connection, thereby reducing the affection by hands of the user.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile terminal comprising an antenna assembly comprising:

a radiation body;

an antenna feed portion;

a RF feed portion;

a first branch having one end electrically connecting to the antenna feed portion, and another end electrically connects to a first feed point of the radiation body, the first feed point dividing the radiation body into a first radiation portion and a second radiation portion; a second branch electrically connecting to a second feed point of the second radiation portion; an impedance matching circuit coupled between the antenna feed portion and the RF feed portion, the impedance matching circuit receiving the low frequency signals and matching the impedance, then feeding to the antenna feed portion;

a metal frame including a first holding portion, a second holding portion opposed to the first holding portion, a connection portion locating between the first and second holding portions, and two gap between two ends of the connection portion and the two holding portions, wherein the connection portion serves as the radiation body;

a receiving space formed by the metal frame, a speaker accommodated in the receiving space and having a housing, a mother board in the receiving space, and a ground plate, wherein the first and second branches locate on surfaces of the housing, and the RF feed portion locates on the mother board.

2. The mobile terminal as described in claim 1, wherein the housing defines an upper surface carrying the second branch, a lower surface opposed to the upper surface, and a side surface connecting the upper and lower surfaces.

3. The mobile terminal as described in claim 2, wherein the first branch includes a first segment locating on the upper surface and electrically connecting to the first feed point, a second segment extending vertically away from the first segment, a third segment extending vertically from the second segment toward the radiation body, a fourth segment extending from the third segment and locating on the side surface, and a fifth segment extending from the fourth segment and locating on the lower surface, a width of the first segment being greater than that of the third segment.

4. The mobile terminal as described in claim 3, wherein the fifth segment electrically connects to the antenna feed portion.

5. The mobile terminal as described in claim 1, wherein the first and second holding portions include ground terminals for electrically connecting to the ground plate.

6. The mobile terminal as described in claim 1, wherein the impedance matching circuit comprises a capacitor parallel connecting to an inductance.

* * * * *